United States Patent [19]

Guthrie

[11] Patent Number: 5,042,222

[45] Date of Patent: Aug. 27, 1991

[54] METHOD AND APPARATUS FOR THE TRANSFER OF BUILDING MATERIALS

[75] Inventor: John F. Guthrie, Paragon, Ind.

[73] Assignees: C. John Rew; Rick J. Rew, both of Lenexa, Kans.

[21] Appl. No.: 567,168

[22] Filed: Aug. 14, 1990

[51] Int. Cl.[5] ..... E04G 21/14

[52] U.S. Cl. ..... 52/749; 414/10; 414/11

[58] Field of Search ..... 52/749; 269/910, 13, 269/14; 414/10, 11; 248/291

[56] References Cited

U.S. PATENT DOCUMENTS

| | | | |
|---|---|---|---|
| 2,849,728 | 9/1958 | Gyllenberg | 248/291 |
| 3,058,602 | 10/1962 | Kilman | 414/11 |
| 3,178,038 | 4/1965 | Love | 414/11 |
| 3,861,546 | 1/1975 | Montgomery | 414/10 |

*Primary Examiner*—Richard E. Chilcot, Jr.
*Assistant Examiner*—Joanne C. Downs
*Attorney, Agent, or Firm*—Richard C. Litman

[57] ABSTRACT

Drywall sheets and other construction materials may be more easily transferred into and within a partially completed building shell by the use of a drywall slideboard. The drywall slideboard consists of upper and lower hinge plates separated by a horizontal hinge. The upper hinge plate supports a removable top plate, which in turn supports a slide plate of a relatively low friction coefficient material. The lower hinge plate is supported by retaining members which permit the drywall slideboard to be temporarily installed upon a section of lumber stock such as a two by four for use, or alternatively the top plate and slide plate may be easily removed from the remainder of the slideboard. Methods of use are further described in which the drywall slideboard may be installed over a two by four or similar material at a window opening and used to facilitate the transfer of building materials into or out of the structure, or alternatively the drywall slideboard may be used to transfer materials up or down a stairway when only the top plate and slide plate are used.

8 Claims, 2 Drawing Sheets

METHOD AND APPARATUS FOR THE TRANSFER OF BUILDING MATERIALS

FIELD OF THE INVENTION

This invention relates generally to tools used in the building construction trade, and more specifically to a device providing for ease of transport of drywall panels or other building materials into a building for later installation, or removing such materials from the building, and methods of using that device.

BACKGROUND OF THE INVENTION

During the latter stages of building construction, many of the materials to be used must be transported into the uncompleted building shell. This is typically done by hand carrying such materials from the delivery site immediately outside the building and passing the materials through a roughed in (i. e., with no window glass, sash, etc. installed) window opening or doorway. Often, due to interior walls, it is more expeditious to pass the materials through a window opening rather than through an exterior doorway and intervening interior doorways.

This leads to potential problems, particularly with relatively heavy but fragile building materials such as drywall sheets or boards, also known as gypsum wallboard. Drywall sheet is typically manufactured in sheets measuring four feet wide by eight to sixteen feet long in several thicknesses, and packaged in bundles of two sheets each. Sheets of greater thickness are relatively heavy, weighing 115 to 290 pounds per bundle. Yet the material itself is relatively soft and frangible and can be easily dented or broken. When passing such materials through roughed in window openings, great care must be used in order to prevent damage from occurring to the edges of the drywall sheets as they come in contact with the relatively rough wood or other material of the window opening. If a finished frame has been installed in the window opening, even greater care must be exercised in order to prevent damage to the finished frame. This results in a great deal of stress for the workers handling the sheets, due to the necessity of supporting the sheets so as to prevent damage to them from scraping them on the window opening. This particular task of building construction has led to back and other injuries to workers involved in transferring such materials into an uncompleted building shell, even though often the materials are transferred directly from a truck lifting boom to a point immediately outside the opening in the building shell.

Furthermore, it is sometimes necessary to transfer such drywall sheets from one level to another up a flight of stairs. In order to prevent damage to the sheets, it is necessary for a worker or workers to carry the sheets up the stairs in order to prevent contact with the edges of the step treads. A single worker or even two workers are limited in the number of sheets they can carry due to the relatively large size and weight of the sheets.

The need arises for a device which may be quickly and easily installed upon a window or similar opening in a building, which may be used to support drywall sheets or other relatively heavy, bulky materials as they are passed through such an opening into the building interior. The device should be easily removable and also easily adaptable for use on stairways or the like so such drywall sheets or other materials may be supported by the device rather than being carried and completely supported by a worker. The device should offer a relatively low friction surface on which the building materials may be supported and slid for transfer.

DESCRIPTION OF THE RELATED ART

While many support devices which attach to window frames or other openings are known, none are known which provide for the efficient transfer of building materials through such an opening. Scott U.S. Pat. No. 154,720 discloses a scaffold intended for use in a window opening, which derives a portion of its support from a crossmember which is positioned across the interior of the opening. The device is intended to be used in pairs to support scaffolding on the exterior of building, and each unit is intended to be secured in a single opening. The device is quite bulky, which may well preclude providing sufficient space to pass four by eight foot or longer sheet material through the opening once the device is installed. Furthermore, no provision is made for a relatively low friction plate for the materials to be supported and slid upon.

Trafton U.S. Pat. No. 353,768 discloses a scaffold bracket having a similar function to the device of the Scott patent described above. Most of the same disadvantages also apply when compared to the present invention. Furthermore, the low friction plate of the present invention may swivel in order to provide the maximum bearing surface to the construction materials supported thereon, whatever their angle maybe from the horizontal. The devices of the above cited patents would indent the edge of a sheet of drywall material which was tilted from the horizontal, due to the relatively sharp fixed edge of the support surface. Moreover, the devices disclosed in the above cited patents cannot be used for the support of materials being transferred up a flight of stairs.

Roberts U.S. Pat. No. 170,115 discloses a scaffold similar to that of the Scott patent cited above, except that the upper support is intended to be wedged between the side portions of the window frame rather than extending across the interior of the frame. The same objections apply to this device as to the other devices cited.

Finally, Bartus et al. U.S. Pat. No. 4,730,738 discloses an adjustably tiltable wall shelf assembly. This device may be temporarily installed upon a vertical edge in a manner similar to the present invention by means of the saddle like arrangement provided, but only a portion of the support shelf is tiltable, thereby rendering the device no more useful for the purpose of the present invention than those other devices cited above. In addition, any adjustments must be made manually to one of a relatively few finite, fixed positions, unlike the present invention which automatically and infinitely adjusts to the position of the load supported thereupon. Furthermore, the device possesses at least two edges which have the same disadvantages for the purpose of the present invention as those other devices cited above.

None of the above noted patents, either singly or in combination, are seen to disclose the specific arrangement of concepts disclosed by the present invention.

SUMMARY OF THE INVENTION

By the present invention, an improved method and apparatus for the transfer of building materials into and within a building is disclosed.

Accordingly, one of the objects of the present invention is to provide an improved method of transferring building materials into or out of a window or similar opening in the wall of an uncompleted building shell.

Another of the objects of the present invention is to provide an improved method for the transfer of building materials up or down a flight of stairs from one level to another.

Still another of the objects of the present invention is to provide for a device which may be placed upon a temporarily attached support frame at an opening, for the support of building materials which may be transferred through such an opening.

Yet another of the objects of the present invention is to provide for a device which provides an automatically adjusting tiltable support platform, thereby providing a broader surface for the support of materials resting thereupon.

An additional object of the present invention is to provide for a device which support platform is of a relatively low coefficient of friction, thereby permitting materials to be easily slid over the surface of such platform with no damage.

Another object of the present invention is to provide for a device which may be quickly and temporarily modified for use on stairways or other such areas.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
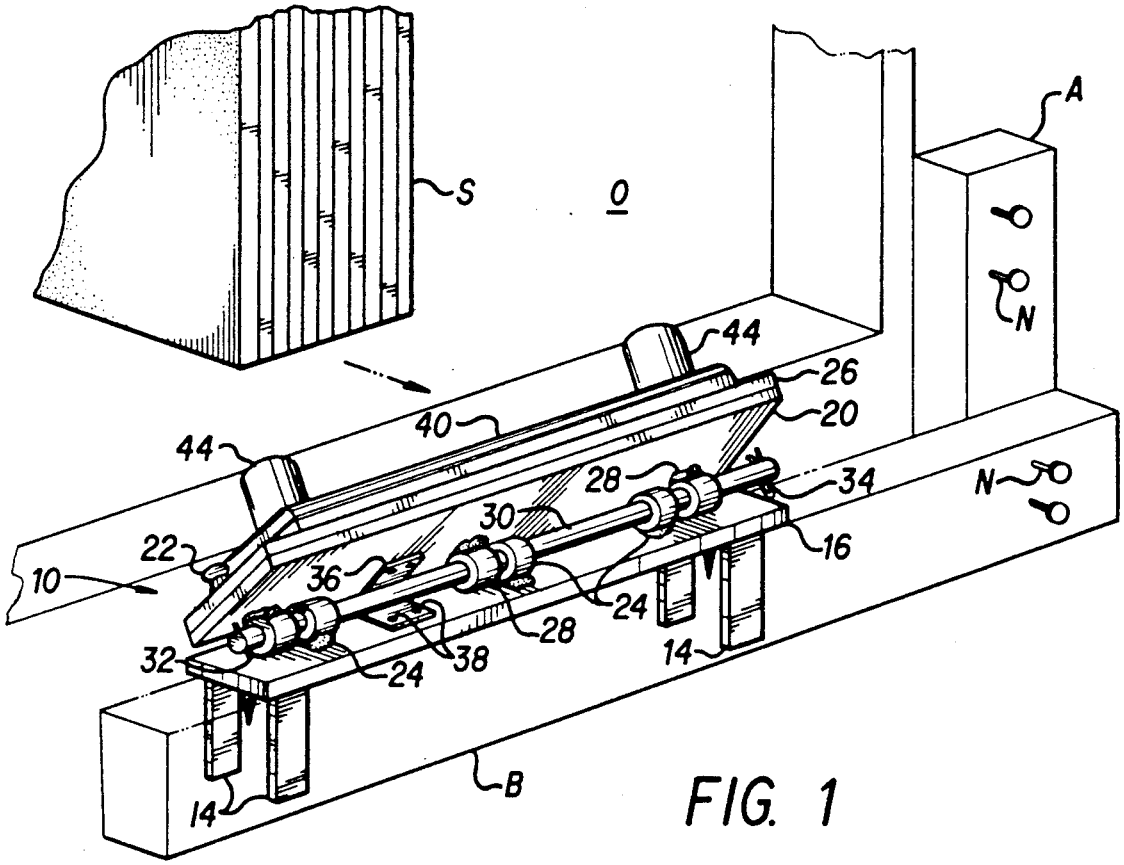
FIG. 1 is a rear perspective view of the present invention, hereinafter known as a drywall slideboard, in use.
Figure 2:
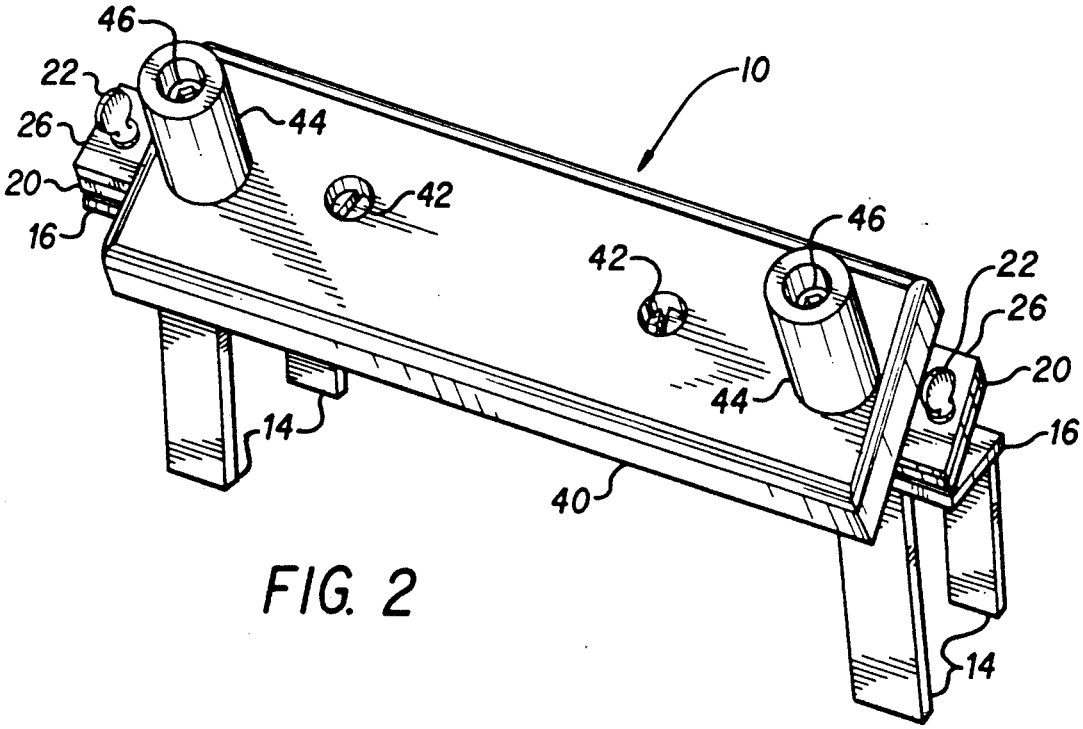
FIG. 2 is a front perspective view of the drywall slideboard.
Figure 4:
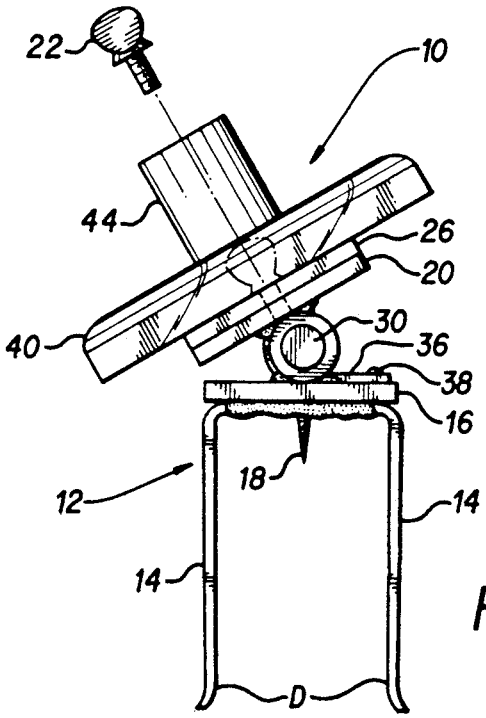
FIG. 4 is an end view of the drywall slideboard.

Referring now to the drawings, particularly FIGS. 1 and 2, the present invention will be understood to comprise a drywall slideboard 10 to aid the transfer of drywall panels or other building materials through an opening O in a building wall or from one level to another by means of a staircase or the like. Drywall slideboard 10 is normally supported by essentially inverted U-shaped members 12 which may be installed over the narrowest dimension of a standard "two by four" section B. As such stock actually measures about one and one half inches across its narrowest dimension, the distance D (better shown in FIG. 4) between each leg 14 of U-shaped member 12 is preferably slightly greater than one and one half inches in order to be easily slipped over and removed from such two by four stock B. U-shaped member 12 may be formed in order to fit other lumber dimensions as desired.

A lower hinge plate 16 is welded or otherwise secured to inverted U-shaped members 12 in a manner permitting lower hinge plate 16 to extend along the major axis of any two by four B or other lumber stock which may be straddled by members 12. Lower hinge plate 16 may also contain sharpened gripping members 18 such as screws or other suitable means, more clearly shown in FIG. 4, in order to better grasp any lumber stock B over which drywall slideboard 10 may be placed and thereby prevent slippage along the length of such stock B.

Lower hinge plate 16 provides attachment for lower hinge components 24, which are welded or otherwise secured along the upper surface of the major axis centerline of lower hinge plate 16. In turn, upper hinge plate 20 provides attachment for upper hinge components 28, which are alternatingly installed along the major axis of upper hinge plate 20 in order to closely fit between lower hinge components 24. Lower and upper hinge components 24 and 28 are formed of cylindrical sections and may be welded or otherwise secured to lower and upper hinge plates 16 and 20 respectively in order to provide a common concentric axis for the installation of hinge pin 30. Hinge pin 30 is retained within lower and upper hinge components 24 and 28 by pin 32 at one end of hinge pin 30, and removable keeper 34 at the opposite end of hinge pin 30. Removable keeper 34 provides for the disassembly of lower and upper hinge plates 16 and 20 if so desired.

Upper hinge plate 20 may be based in a given orientation by means of spring 36. Spring 36 provides pressure between lower hinge plate 16 and upper hinge plate 20, thereby causing upper hinge plate 20 to be tilted toward one side of drywall slideboard 10. Spring 36 may be held in place upon lower hinge plate 16 by means of spring attachment screws 38 or other suitable means.

Top plate 26 is secured to upper hinge plate 20 by means of removable wing screws 22, and in turn slide plate 40 is attached to the upper side of top plate 26 by means of slide plate screws 42 or other suitable means. The attachment holes for slide plate screws 42 within slide plate 40 are preferably counterbored, thus permitting the heads of slide plate screws 42 to remain beneath the upper surface of slide plate 40. It is desirable that the upper surface of slide plate 40 be of as low a coefficient of friction and to present as smooth and unbroken a surface as practicable in order that materials moved across its surface are not damaged. Slide plate 40 is thus preferably formed of a material which naturally provides a low coefficient of friction, such as TEFLON, NYLON or other relatively firm, smooth plastic like material.

Each end of slide plate 40 provides attachment for side retaining rollers 44, which are secured through slide plate 40 to top plate 26 by roller retaining screws 46 or other suitable means.

As described in the Background of the Invention, drywall sheet panels S and other building materials are generally transferred into buildings by passing the materials through any convenient opening O of sufficient size. Often such an opening O is a roughed in or perhaps finished window opening, particularly when the materials must be transferred to the upper floor or floors of a multiple story building. Generally, such drywall sheets S and perhaps other materials are hoisted by a lifting boom to an upper story window opening O and are then transferred through by workers immediately inside the window opening O, although they may also be transferred by hand through any suitable opening O at or near ground level.

In order to more easily perform this activity, drywall slideboard 10 may be temporarily installed immediately within any suitable window opening O. Such installation may be accomplished by temporarily installing a section of two by four or other suitable material A at each side of the opening near the lower edge, as shown in FIG. 1. Another section of two by four or other suitable material B may then be temporarily installed across material A, so that component B extends horizontally across and immediately inside and parallel to the lower edge of the opening. This provides spacing equal to the thickness of components A between the inner edge of the opening O and component B, thus allowing drywall slideboard 10 to be temporarily installed atop component B by means of inverted U-shaped members 12. Components A and B are preferably installed using nails N, which may be left partially undriven in order to facilitate their removal at the end of the operation.

Preferably, drywall slideboard 10 is installed so that the slope of slide plate 40 provided by spring 36 bearing upon top plate 26 will be downward toward the opening O. When drywall sheet S is then transferred through the opening O onto slide plate 40, slide plate 40 will automatically adjust to an angle conforming to that of the lower edges of the drywall sheet S. This automatically provides a larger surface bearing area for drywall sheet S to rest or slide upon, thus reducing the chance of damage to the sheets S. The weight of drywall sheets S will tend to force gripping members 18 into temporary component B, thus preventing any movement of drywall slideboard 10 during the operation. A worker or workers within the building may then relatively easily draw the drywall sheets S into the building due to the relatively low coefficient of friction provided by the material of which slide plate 40 is formed. Side retaining rollers 44 will prevent drywall sheets S from slipping past either end of slide plate 40 and being damaged. Roller retaining screws 46 are preferably assembled through slide plate 40 and into top plate 26 so as to permit side retaining rollers 44 to revolve freely about roller retaining screws 46, thus further reducing friction. When the desired transfer of material is completed, drywall slideboard 10 may be removed from component B of the temporary framing, and temporary components B and A removed.

Figure 3:
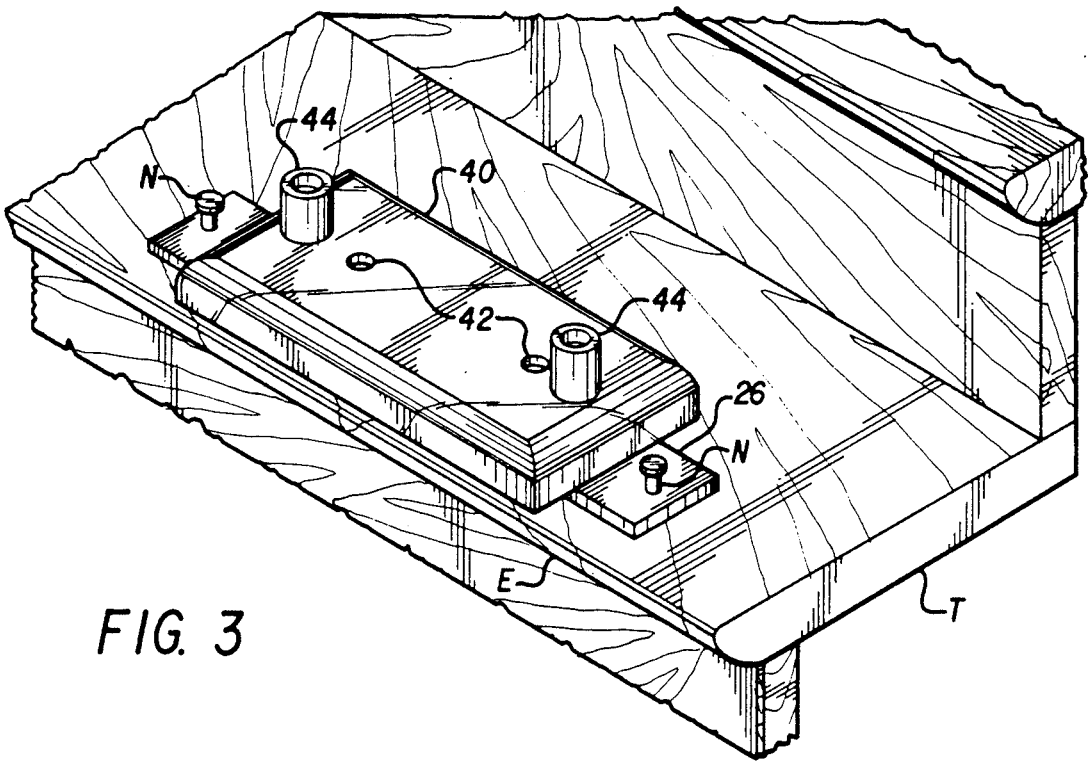
FIG. 3 is a front perspective view of some of the components of the drywall slideboard as it would be used for the transfer of building materials on a staircase.

At times it may be desirable to transfer drywall sheets S from one level to another within the building. Drywall slideboard 10 may be used to great effect during such an operation by removing wing screws 22 and thus removing slide plate 40 and top plate 26 from the remainder of the components of drywall slideboard 10. The holes remaining in top plate 26 from the removal of wing screws 22 provide for the nailing of top plate 26, and thus slide plate 40, into position adjacent the nose edge E of tread T of the stairway as shown in FIG. 3. As in the temporary securing of components A and B for the installation of drywall slider 10 described above, any nails N used to secure top plate 26 and slide plate 40 to a stair tread T may be left partially undriven to facilitate their removal when the operation is completed. More than one top plate 26 and slide plate 40 may be used in this operation, and in fact it is desirable to space such top plates 26 and slide plates 40 in several treads T in order to permit any drywall sheets S to be supported by at least two slide plates 40 at any given time as the drywall sheets 10 are transferred.

As in the case of transferring drywall sheets S or other materials through an opening O, the components 26 and 40 of the drywall slideboards 10 used in this operation may be easily removed when the operation is complete by merely removing any nails N or other fasteners which were used to secure top plate 26 and slide plate 40 to the treads T.

It is to be understood that the present invention is not limited to the sole embodiment described above, but encompasses any and all embodiments within the scope of the following claims.

I claim:

1. A drywall slideboard for the transfer of building materials into and within a partially completed building structure, the apparatus comprising;

a substantially planar hinge plate of rectangular shape, the lower surface of said lower hinge plate providing attachment for two or more retaining members, each of said retaining members comprising a horizontal member extending laterally across and perpendicular to the major dimension of said lower hinge plate, said horizontal member defined by a downwardly extending vertical member at each end of said horizontal member and thus forming an essentially inverted U shape for each of said retaining members, said lower hinge plate containing lower hinge components of cylindrical section affixed to the upper surface thereof, an upper hinge plate, said upper hinge plate of substantially the same dimensions as said lower hinge plate and containing upper hinge components of cylindrical section affixed to the lower surface thereof and cooperating with said lower hinge components, a hinge pin passing through and securing said upper and said lower hinge components and forming a hinge axis substantially parallel to the major axis of said drywall slideboard, a top plate, said top plate of substantially the same dimensions as said lower hinge plate and removably secured to the upper surface of said upper hinge plate, a slide plate, said slide plate formed of a substantially planar sheet of material of relatively low friction coefficient, and said slide plate having a major dimension, and said slide plate secured to the upper surface of said top plate and having a substantially rectangular shape.

2. The drywall slideboard of claim 1, including;

spring means biasing said upper hinge plate and said lower hinge plate to a predetermined position, said predetermined position defined by contact between one edge of said upper hinge plate and one edge of said lower hinge plate.

3. The drywall slideboard of claim 1 including;

gripping means comprising sharply pointed extensions, said gripping means depending beneath said lower surface of said lower hinge plate.

4. The drywall slideboard of claim 1 including;

side retaining rollers, said side retaining rollers located near opposite ends of the major dimension of said slide plate, said side retaining rollers secured by roller retaining screws, said roller retaining screws threadedly fastened through said slide plate and into said top plate, and said roller retaining screws forming an axis normal to said slide plate whereupon said side retaining rollers may revolve.

5. The drywall slideboard of claim 1 wherein;

said vertical members of said retaining members are spaced one and one half inches apart.

6. A method of use of a drywall slideboard of claim 1 comprising the following steps:

temporarily securing a first support member at each end of the lower edge of one side of an opening in a building wall, temporarily securing a second support member horizontally across each of said first support members, orienting said slide plate of said drywall slideboard so that said slide plate is sloped downward toward said opening, placing said drywall slideboard upon said second support member in a manner that said retaining members extend vertically downward on each side of said second support member, placing drywall sheets or other building materials upon said slide plate so that the minor dimension of said drywall sheets or other materials is parallel to said major dimension of said slide plate, sliding said drywall sheets or other building materials across said slide plate from one side of said building wall opening through said opening to the opposite side of said building wall opening, removing said drywall slideboard from said second support member, removing said second support member from said first support members, and removing said first support members from said lower edge of said opening.

7. A further method of use of a drywall slideboard according to claim 6 comprising the following steps:

removing said top plate and said slide plate from said upper hinge plate of said drywall slideboard, temporarily securing said top plate and said slide plate of said drywall slide board adjacent the nose edge of a stairway tread, placing a plurality of drywall sheets or other building materials upon said slide plate so that said minor dimension of said drywall sheets or other materials is parallel to said major dimension of said slide plate, sliding said drywall sheets or other materials across said slide plate in a direction toward the top or bottom of said stairway as desired, and removing said top plate and said slide plate of said drywall slideboard from said stairway tread.

8. A method of use of a drywall slideboard according to claim 7 further comprising:

temporarily securing more than one of said top plates and said slide plates of said drywall slideboards to a corresponding number of said stairway treads.

* * * * *